US011475718B2

(12) United States Patent
Murray et al.

(10) Patent No.: US 11,475,718 B2
(45) Date of Patent: Oct. 18, 2022

(54) IN-VEHICLE NOTIFICATIONS

(71) Applicant: Ford Global Technologies, LLC, Dearborn, MI (US)

(72) Inventors: Andrew John Murray, Colchester (GB); Torsten Gerhardt, London (GB); Ian Sutherland Wright, Chelmsford (GB); Christopher Wright, Somerville, MA (US); Daniel Tauber, Edling (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 17/144,321

(22) Filed: Jan. 8, 2021

(65) Prior Publication Data

US 2021/0217253 A1 Jul. 15, 2021

(30) Foreign Application Priority Data

Jan. 10, 2020 (GB) ..... 2000369

(51) Int. Cl.
*G07C 5/00* (2006.01)

(52) U.S. Cl.
CPC ..... *G07C 5/006* (2013.01)

(58) Field of Classification Search
CPC ..... G07C 5/006; G07C 5/0808; B60W 50/00; B60W 50/14; B60W 2050/0043; B60W 2050/146; B60W 2530/209; B60W 2556/10
See application file for complete search history.

(56) References Cited

U.S. PATENT DOCUMENTS 10,140,785 B1 * 11/2018 Cox ..... G01F 9/02
10,789,789 B1 * 9/2020 Edman ..... G05D 1/12
2006/0103516 A1 * 5/2006 Zang ..... B60N 2/002 340/457
2010/0063717 A1 3/2010 Proefke et al.
2011/0160991 A1 * 6/2011 Crombez ..... B60W 30/182 701/123
2011/0160992 A1 * 6/2011 Crombez ..... B60W 50/14 701/123
2013/0173106 A1 * 7/2013 Konishi ..... B60L 50/61 701/22
2015/0345958 A1 * 12/2015 Graham ..... B60W 10/30 701/22
2016/0334234 A1 * 11/2016 Wild ..... B60L 53/62
(Continued)

OTHER PUBLICATIONS

UKIPO Combined Search and Examination Report for Application No. GB2000369.5 dated Jul. 3, 2020 (7 pages).

*Primary Examiner* — Curtis J King
(74) *Attorney, Agent, or Firm* — Frank A. MacKenzie; Bejin Bieneman PLC

(57) ABSTRACT

A notification can be generated to notify a user of a value of a first parameter of a vehicle. Generating the notification includes identifying a second parameter based on an association of the second parameter with the first parameter; comparing the value of the first parameter to a first threshold value and a second threshold value; and generating the notification notifying the user of the value of the first parameter based on a value of the second parameter if the value of the first parameter is between the first and second thresholds.

21 Claims, 2 Drawing Sheets

(56) References Cited

U.S. PATENT DOCUMENTS

| | | | | |
|---|---|---|---|---|
| 2018/0025554 | A1* | 1/2018 | Gibson | G01C 21/3679 701/36 |
| 2018/0217101 | A1* | 8/2018 | Hopper | G01N 29/222 |
| 2018/0299313 | A1* | 10/2018 | Rovik | B60R 16/0236 |
| 2018/0315256 | A1* | 11/2018 | Weber | G01C 21/3697 |
| 2019/0080527 | A1* | 3/2019 | Cox | G01F 9/02 |
| 2019/0111939 | A1* | 4/2019 | Ulrey | B60W 50/14 |

* cited by examiner

300

302
Determine threshold
304
Obtain value of 1st parameter
Identify 2nd parameter
202
204
Compare 1st parameter
206
212
Compare 2nd parameter
208
Generate notification based on 1st parameter
210
Generate notification based on 2nd parameter

IN-VEHICLE NOTIFICATIONS

CROSS-REFERENCE TO RELATED APPLICATION

This patent application claims priority to United Kingdom Patent Application No. GB2000369.5 filed Jan. 10, 2020, which is hereby incorporated by reference in its entirety.

BACKGROUND

Vehicles, such as motor vehicles, typically comprise a plurality of sensors which measure parameters of the vehicle, e.g. parameters reflecting the condition of systems of the motor vehicle. For example, a vehicle may comprise a sensor for determining the quantity of a consumable medium, such as windscreen washer fluid, remaining within a reservoir, e.g. a washer bottle, on the vehicle.

The vehicles may further comprise a notification system configured to notify a user or occupant of the vehicle when the parameter is outside a desirable range. For example, the notification system may be configured to generate a notification when a value determined by a sensor is below a predetermined threshold, e.g. indicating that the washer fluid has been depleted.

It is desirable to improve the way in which the vehicle notification determines whether a notification should be generated in order to enhance the utility of the notifications provided to the user or driver.

SUMMARY

According to an aspect of the present disclosure, there is provided a method of generating a notification, the notification to notify a user of a value of a first parameter of a vehicle, the method comprising:

identifying a second parameter based on an association of the second parameter with the first parameter;

comparing the value of the first parameter to a first threshold value and a second threshold value; and generating the notification notifying the user of the value of the first parameter based on a value of the second parameter if the value of the first parameter is between the first and second thresholds.

In other words, a determination of whether the notification is generated may be made based on the value of the second parameter, if the value of the first parameter is between the first and second thresholds. The form or content of the notification may be determined based on the value of the second parameter. Additionally or alternatively, the form or content of the notification may be determine based on the comparison between the value of the first parameter with the first and second threshold values, e.g. when the notification is generated based on the second parameter.

Notifying the user of the value of the first parameter may comprise communicating the value of the first parameter to the user. Alternatively, notifying the user of the value of the first parameter may comprise communicating to the user that the value of the first parameter is within or outside of one or more determined ranges, e.g. less than or greater than a predetermined value.

The notification may be generated if a value of the second parameter has a predetermined value or is within one or more predetermined ranges. The one or more predetermined ranges may comprise closed or open ranges.

The first parameter may be a different parameter from the second parameter.

The method may comprise comparing the value of the second parameter to a third threshold value. The notification may be generated based on the comparison between the value of the second parameter with the third threshold value if the value of the first parameter is between the first and second thresholds.

The method may further comprise generating the notification based on the comparison of the value of the first parameter with the first and second threshold values if the value of the first parameter is greater than both of the first and second threshold values or the value of the first parameter is less than both of the first and second threshold values.

In other words, a determination of whether the notification is generated may be made based on the value of the first parameter, if the value of the first parameter is greater than both of the first and second threshold values or the value of the first parameter is less than both of the first and second threshold values.

For example, the notification may be generated if the value of the first parameter is greater than both of the first and second threshold values. Alternatively, the notification may be generated if the value of the first parameter is less than both of the first and second threshold values.

The method may further comprise deferring the generation of the notification based on the value of the second parameter.

The first parameter may comprise a remaining quantity of a consumable of the vehicle. The first parameter may comprise a temperature and/or pressure, e.g. of oil, coolant, an acceleration, a function of a safety system of the vehicle, and/or an input from a camera on the vehicle.

The second parameter may comprise a rate of change of the first parameter. For example, the second parameter may comprise a rate of use of the consumable or a parameter indicative of a rate of use of the consumable.

Additionally or alternatively, the second parameter may comprise a time of day, week, month or year. Additionally or alternatively again, the second parameter may comprise a location or predicted future location of the vehicle. Additionally or alternatively, again the second parameter may comprise an indication of a proximity of the vehicle to a service station or garage and/or proximity of a route planned or predicted to be performed by the vehicle to a service station or garage. Additionally or alternatively again, the second parameter may comprise an environmental condition in which the vehicle is operating or is predicted to operate.

The method may comprise determining a value of the first and/or second threshold based on a current, historical and/or expected driving condition of the vehicle. The driving condition may be one or more of urban, rural and motorway driving.

The method may comprise determining, e.g. precalibrating, a value of the first and/or second threshold based on a model cargo storage configuration and/or passenger compartment configuration of the vehicle.

The method may comprise determining, e.g. precalibrating, a value of the first and/or second threshold based on an anticipated use of the vehicle.

According to another aspect of the present disclosure there is provided a notification system for a vehicle, the notification system comprising:

a sensor configured to determine a first parameter of the vehicle; and a controller configured to:

identify a second parameter based on an association of the second parameter with the first parameter;

compare the value of the first parameter to a first threshold value and a second threshold value; and generate a notification notifying the user of the value of the first parameter based on the second parameter if the value of the first parameter is between the first and second thresholds The first parameter may relate to the operation of a system of the vehicle. For example, the first parameter may determine or correspond to an efficacy or capacity of the system of the vehicle.

The first parameter may be a fuel level, a washer liquid level, an oil level, a reductant, level, a coolant level, an oil temperature, a coolant temperature, an oil pressure, a battery voltage or state of charge, or any other vehicle parameter.

The controller may be configured to perform the above-mentioned method.

The sensor may be a fuel level sensor, a washer liquid level sensor, an oil level sensor, a reductant level sensor, a coolant level sensor, an oil temperature sensor, a coolant temperature sensor, an oil pressure sensor, a battery voltage or state of charge sensor, or any other vehicle sensor, e.g. indicating an operating parameter of a system of the vehicle.

To avoid unnecessary duplication of effort and repetition of text in the specification, certain features are described in relation to only one or several aspects or implementations of the disclosed subject matter. However, it is to be understood that, where it is technically possible, features described in relation to any aspect or implementation of the disclosed subject matter may also be used with any other aspect or implementation of the disclosed subject matter.

BRIEF DESCRIPTION OF THE DRAWINGS

For a better understanding of the presently disclosed subject matter, and to show more clearly how it may be carried into effect, reference will now be made, by way of example, to the accompanying drawings, in which.

DETAILED DESCRIPTION

The present disclosure relates to a notification system for a vehicle, such as a motor vehicle (e.g. car, van, truck, motorcycle etc.), an industrial or agricultural vehicle (e.g. tractor, forklift, bulldozer, excavator etc.), a marine vessel, aircraft or any other type of vehicle.

Figure 1:
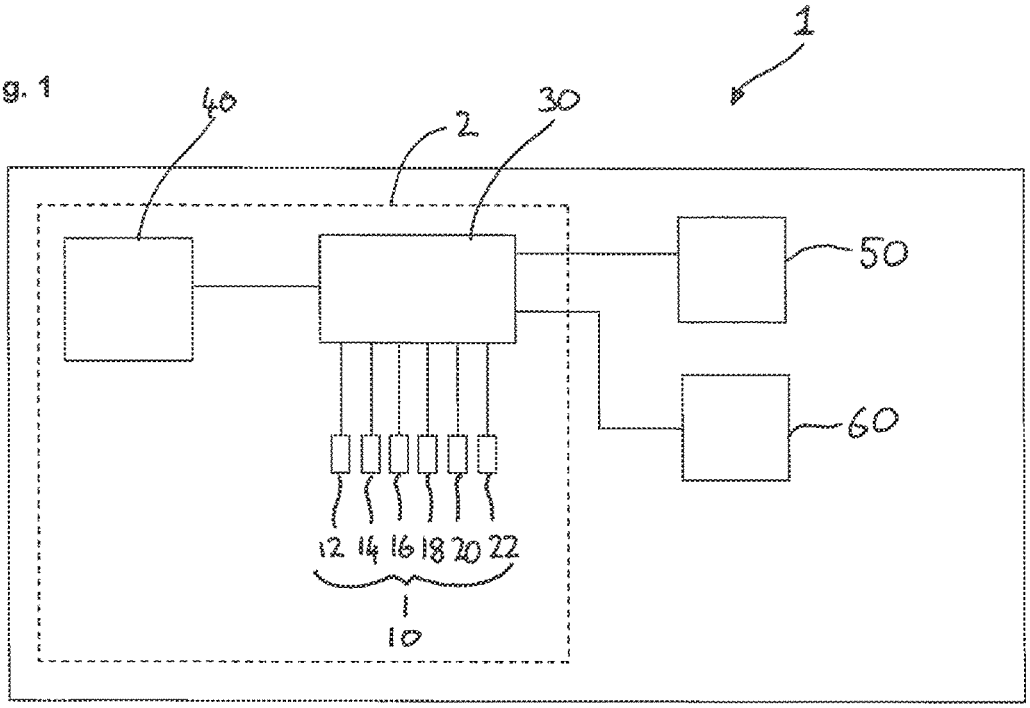
FIG. 1 is a schematic view of a vehicle comprising a notification system according to the present disclosure.

With reference to FIG. 1, a vehicle 1, such as a motor vehicle, may comprise a notification system 2, according to arrangements of the present disclosure. The notification system 2 comprises one or more sensors 10 and a notification system controller 30. The sensors 10 may be configured to determine respective first parameters relating to the vehicle, e.g. indicating an operating condition of one or more systems of the vehicle.

The sensors 10 may comprise one or more sensors configured to determine quantities, e.g. remaining quantities, of one or more consumable mediums of the vehicle respectively. For example, the sensors may comprise a fuel level sensor 12, configured to determine a quantity of fuel remaining in a fuel tank of the vehicle, an oil level sensor 14, configured to determine quantity of oil within an oil system of the vehicle, e.g. within an oil sump, and a washer fluid level sensor 16, configured to determine a quantity of washer fluid within a washer bottle of the vehicle.

In some arrangements, the notification system may comprise one or more other sensors for determining the quantities of one or more other consumable mediums of the vehicle, such as engine coolant and/or aqueous urea, e.g. to be used as a reductant within an exhaust after treatment system of the vehicle, in addition or as alternative to the sensors mentioned above.

Additionally or alternatively, the sensors 10 may comprise one or more sensors configured to determine any other respective parameters of the vehicle, e.g. indicative of the operation of one or more systems of the vehicle. For example, the sensors may comprise a coolant temperature sensor 18, an oil temperature sensor 20 and/or an oil pressure sensor 22. Additionally or alternatively, the sensors 10 may comprise an acceleration sensor and security sensor, for sensing a parameter relating to a security system of the vehicle, and/or a camera on the vehicle, e.g. for detecting objects around the vehicle.

The sensors 10 are operatively connected to the notification system controller 30. The notification system controller is configured to generate one or more notifications based on respective values of parameters of the vehicle, e.g. as determined by the respective sensors.

The notification system 2 may further comprise a user interface device 40 configured to communicate the notifications generated by the notification system controller 30 to a user or occupant of the vehicle. For example, the user interface device 40 may comprise a display screen or an arrangement of indicator lights, e.g. provided as part of an instrument cluster of the vehicle. Additionally or alternatively, the user interface device 40 may comprise a speaker configured to communicate the notifications audibly, e.g. as a tone or audio message. Additionally or alternatively again, the user interface device 40 may comprise a device for communicating the notifications to the user/occupant in any other way.

Figure 2:
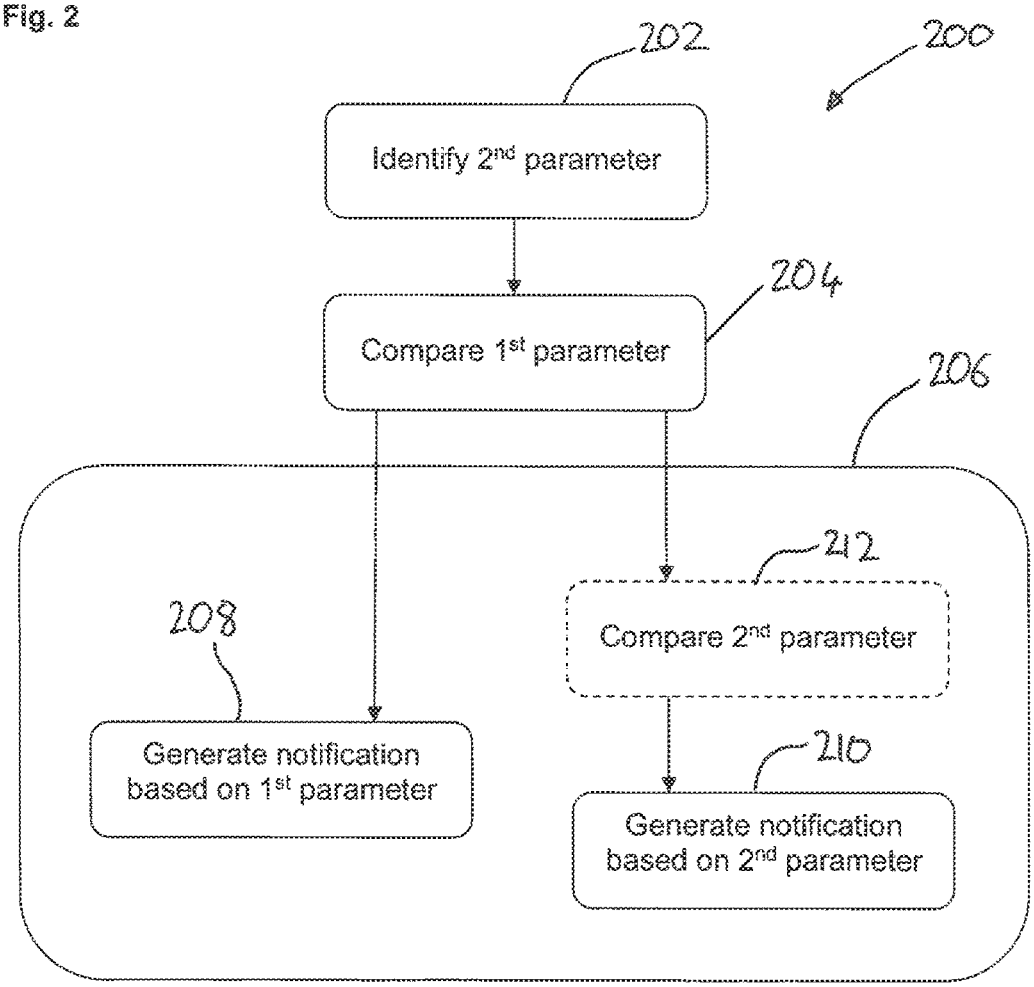
FIG. 2 is a flow chart illustrating a method of generating a notification according to the present disclosure.

With reference to FIG. 2, the notification system controller 30 may be configured to generate the notifications using a method 200, according to arrangements of the present disclosure. In the arrangement described below, the method 200 is used to generate a particular notification for notifying the user/occupant of a value of a particular one of the first parameters determined by one or more of the sensors 10. However, it will be appreciated that the method 200 may be used to generate a plurality of notifications for notifying the user/occupant to the values of a plurality of the first parameters, e.g. by performing the below mentioned blocks of the method 200 in respect of the plurality of notifications and associated first parameters simultaneously. Alternatively, the blocks of the method 200 may be repeated for more than one or each notification that may be generated, in order to determine whether the particular notifications should be generated.

The method 200 comprises a first block 202 at which one or more second parameters are identified that are associated with the first parameter and/or the notification that may be generated. The one or more second parameters are associated with the first parameter in that the second parameters can provide a contextual indication of whether it is desirable to notify the user/occupant of the value of the first parameter, e.g. by generating the notification. In particular, the second parameter may provide an indication of whether it is desirable, e.g. helpful or useful, to notify the user/occupant to the value of the first parameter based on the value of the first parameter relative to the first and second threshold values.

The second parameter may comprise a time, e.g. a time of day, week, month or year. In some arrangements, the second parameter may indicate a current season, e.g. spring, summer, autumn or winter.

Returning the FIG. 1, the vehicle 1 may comprise a vehicle controller 50, such as a trip computer, configured to determine the time of day, week, month or year and optionally the current season. The vehicle controller 50 may be operatively connected to the notification system controller 30 and the notification system controller may determine the value of the second parameter from the vehicle controller 50.

Additionally or alternatively, the second parameter may comprise a location of the vehicle and/or a route to be performed by the vehicle. The second parameter may comprise a distance of a route currently being performed by the vehicle and/or a planned or predicted destination of the current route. In some arrangements, the second parameter may comprise a proximity of the vehicle, or a route planned or predicted to be performed by the vehicle, to a service station or garage, or to a home of the user/occupant or location in which the vehicle is typically stored when not being driven.

The vehicle 1 may comprise a navigation system controller 60, such as a satellite navigation system controller, configured to determine a location of the vehicle. A user/occupant of the vehicle may input a route to be performed by the vehicle into the navigation system controller 60. Alternatively, the navigation system controller may determine, e.g. predict, a route to be performed based on a destination input by the user or predicted by the navigation system controller 60, e.g. based on a location of the vehicle, a time of day, week, month or year and/or previous destinations travelled to by the vehicle and/or the user/occupant.

The notification system controller 30 may determine the value of the second parameter from the navigation system controller 60.

In some arrangements, the functions of the notification system controller 30, vehicle controller 50 and/or the navigation system controller 60 may be performed by a single controller, e.g. comprising one or more modules.

The second parameter may comprise a rate of change of the first parameter. For example, when the first parameter is a quantity of a consumable medium of the vehicle, the second parameter may comprise a rate of use of the consumable medium. The rate of use of the consumable medium may be determined, e.g. by the notification system controller or another controller, based on historical values of the first parameter. Additionally or alternatively, the rate of use of the consumable medium may be determined, e.g. predicted, based on others of the second parameters. For example, a rate of use of washer fluid may be determined at least partially based on the current season. As another example, a rate of consumption of aqueous ammonia may be determine at least partially based on a route to be performed by the vehicle.

In some arrangements, the second parameter may comprise an environmental condition, such as a weather or traffic condition, in which the vehicle is operating or is predicted to operate. For example, if it is raining or snowing it may be determined that a consumable medium of the vehicle may be used at an increased rate.

Returning to FIG. 2, the method 200 comprises a second block 204, at which the value of the first parameter is compared to a first threshold value and to a second threshold value. The first and second threshold values may be different from one another. For example, the first threshold value may be greater than the second threshold value. Alternatively, the second threshold value may be greater than the first threshold value. The first and second threshold values may be determined based on the first parameter or the particular notification that may be generated.

The method 200 further comprises a third block 206, at which the notification, notifying the user of the value of the first parameter, may be generated. Notifying the user of the value of the first parameter may comprise communicating the particular value of the first parameter to the user/occupant. Additionally or alternatively, notifying the user of the value of the first parameter may comprise communicating to the user whether the value of the first parameter is within one or more predetermined closed or open ranges, e.g. greater than the first threshold value and/or the second threshold value or less than the first threshold value and/or the second threshold value.

If, at the third block 206, the value of the first parameter is greater than the first and second threshold values or the value of the first parameter is less than the first and second threshold values, the method 200 may proceed to a fourth block 208, at which the notification is generated based on the comparison between the value of the first parameter and the first and second threshold values.

For example, if the notification is to notify the user/occupant to an oil temperature, the notification may be generated at the fourth block when the value of the first parameter, e.g. oil temperature, is greater than the first and second threshold values. In another example, if the notification is to notify the user/occupant of a level of washer fluid within a washer bottle on the vehicle, the notification may be generated in the fourth block 208 if the value of the first parameter, e.g. washer fluid level, is less than the first and second thresholds.

The form or content of the notification may be determined based on the first parameter and/or the comparison of the value of the first parameter with the first and second thresholds. For example, if the first parameter is a level of washer fluid remaining within a washer bottle, the notification may be an indicator that the washer bottle is empty or a message to refill the washer fluid. As another example, if the first parameter is a battery charge of a battery for powering an electric vehicle, the notification may be a message to recharge the battery and/or may be an indicator of the distance that can be travelled by the vehicle on the remaining charge.

If, at the third block 206, the value of the first parameter is between the first and second threshold values, e.g. inclusive of the first and second threshold values, the method may proceed to a fifth block 210, at which the notification is generated based on the a value of the second parameter.

For example, if the notification is to notify the user/occupant of a level of washer fluid within a washer bottle, the notification may be generated at the fifth block 210 based on the rate of use of the washer fluid.

In some arrangements, the form or content of the notification may be determined based on the value of the second parameter, e.g. If the value of the first parameter is between the first and second threshold values. For example, when the first parameter is a battery charge of a battery for powering an electric vehicle and the second parameter is a distance of a current route of the vehicle or a distance to a location in which the battery is typically recharged, the notification may be a message indicating whether sufficient charge remains for the vehicle to complete its route or return to the a location in which the battery is typically recharged. Alternatively, the notification may be a message providing an option to navigate to a charge point that may be selected by the user.

In further examples, the notification may provide options for reducing power consumption in order to increase a remaining range of the vehicle, e.g. if insufficient batter charge remains to compete a route or return to a recent charge point.

In some arrangements, for example, when the second parameter is a rate of use of a consumable medium, the second parameter may be compared, at a sixth block 212, with a third threshold value. The notification may be generated based on the comparison between the second parameter and the third threshold value, e.g. if the value of the second parameter is greater than or equal to the third threshold value or if the second parameter is less than or equal to the third threshold value.

In one or more examples, e.g. when the first parameter is a quantity of a consumable medium, the second parameter may be a distance of the vehicle, or a route being performed by the vehicle from a service station or garage, e.g. at which the consumable medium may be replenished. In such examples, the notification may be generated, e.g. at the fifth block 210, if the vehicle is within a threshold distance of the service station or garage and/or is approaching or arriving at the service station or garage.

In some arrangements, the generation of the notification may be deferred based on the second parameter. For example, when the first parameter is a level of washer fluid remaining within a washer bottle and the second parameter is a distance to along a route being performed to a service station or garage, generation of the notification may be deferred, e.g. for a determined time or distance until the vehicle is expected to be within a predetermined distance or driving time from the service station or garage.

In another example, when the first parameter is a battery charge of a battery for powering an electric vehicle and the second parameter is a distance of a current route of the vehicle or a distance to a location in which the battery is typically recharged, if the value of the second parameter indicates that the battery charge is sufficient to complete a current route, generation of the notification may be deferred until the route changes, e.g. such that there is no longer sufficient battery charge for the route to be completed, or the vehicle stops at its destination.

Figure 3:
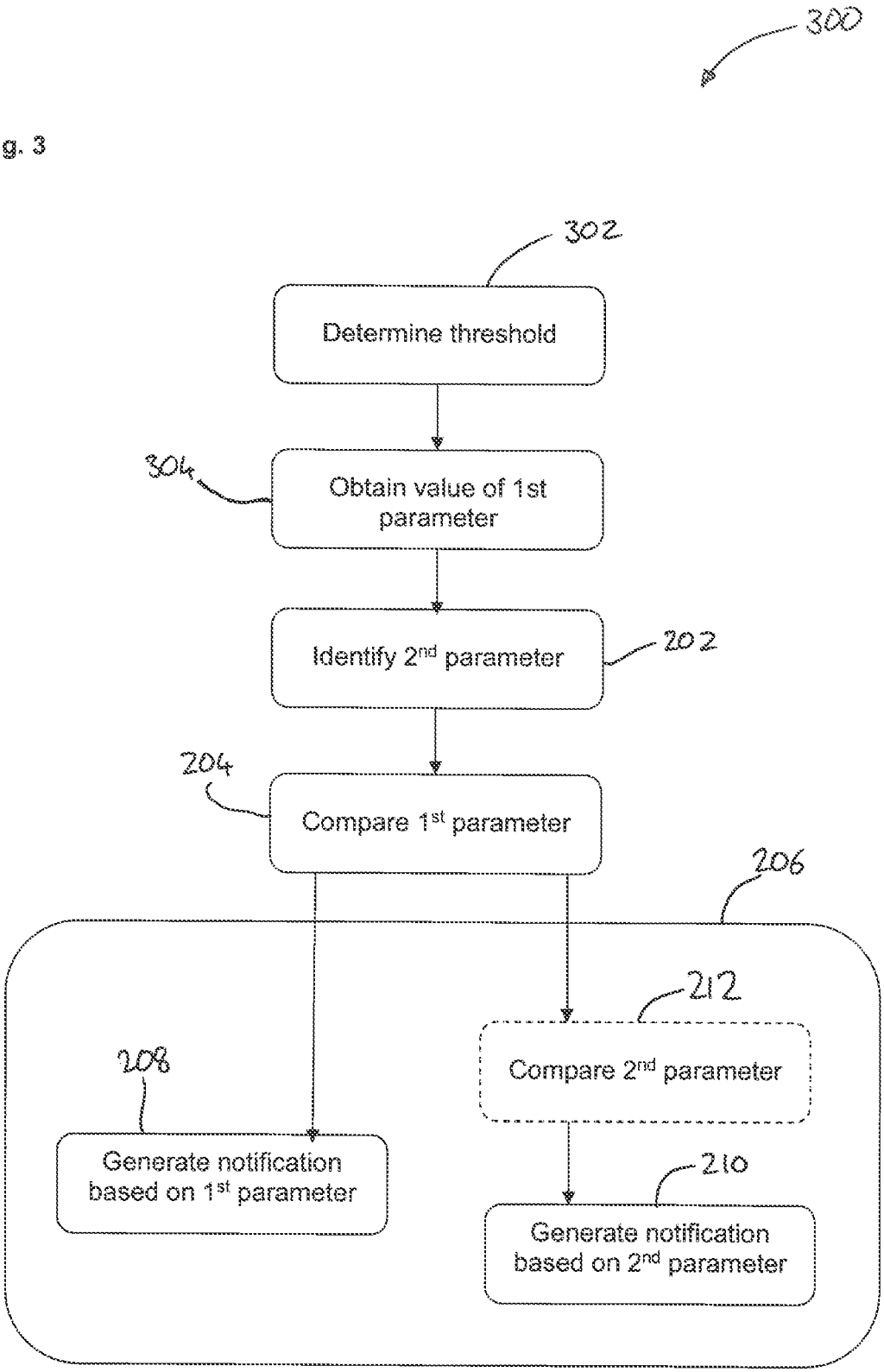
FIG. 3 is a flow chart illustrating another method of generating a notification according to the present disclosure.

FIG. 3 illustrates a method 300 of generating a notification according to one or more arrangements of the disclosure. The method 300 is similar to the method 200 described above and the features described in relation to the method 200 may apply equally to the method 300. Furthermore, blocks of the method 300 having the same reference numbers as blocks of the method 200 may be the same as the blocks of the method 200 described above.

As depicted in FIG. 3, the method 300 may comprise a threshold determination block 302, at which the first and/or second thresholds may be set or determined. As mentioned above, the first and/or second thresholds may be determined based on the first parameter and/or the notification that may be generated. Additionally or alternatively, the first and/or second thresholds may be determined based on a current and/or historical driving condition of the vehicle, e.g. a historical use of the vehicle. The driving condition may be one or more of urban, rural and motorway driving. For example, if the vehicle has historically been used for a greater proportion of motorway driving than urban driving, the value of the first and/or second threshold may be set to a different, e.g. lower or higher, value than if the vehicle had historically been used for a greater proportion of urban driving than motorway driving.

Additionally or alternatively, in some arrangements, the first and/or second thresholds may be determined based on a planned or predicted driving condition of the vehicle.

Additionally or alternatively again, the first and/or second threshold may be a predetermined threshold, e.g. determined during manufacture of the vehicle. The first and/or second threshold may be determined based on a model of the vehicle or a configuration of the vehicle, e.g. a number of seats installed in the vehicle and/or a size of a cargo compartment of the vehicle. For example, the model and configuration of the vehicle may be used to determine an intended use of the vehicle.

The method 300 may further comprise a parameter acquisition block 304, at which a value of the first parameter is obtained, e.g. from a sensor. For example, at the parameter acquisition block 304, the first parameter may be obtained by reading the value of the first parameter from a sensor.

The following additional, numbered statements are also included within the specification and form part of the present disclosure:

Statement 1. A method of generating a notification, the notification to notify a user of a value of a first parameter of a vehicle, the method comprising:

identifying a second parameter based on an association of the second parameter with the first parameter;

comparing the value of the first parameter to a first threshold value and a second threshold value; and generating the notification notifying the user of the value of the first parameter based on a value of the second parameter if the value of the first parameter is between the first and second thresholds.

Statement 2. The method of statement 1, wherein the method comprises comparing a value of the second parameter to a third threshold value, wherein the notification is generated based on the comparison between the value of the second parameter with the third threshold value if the value of the first parameter is between the first and second thresholds.

Statement 3. The method of statement 1 or 2, wherein the method further comprises:

generating the notification based on the comparison of the value of the first parameter with the first and second threshold values if the value of the first parameter is greater than both of the first and second threshold values or the value of the first parameter is less than both of the first and second threshold values.

Statement 4. The method of any of the preceding statements, wherein the form or content of the notification is determined based on the comparison between the value of the first parameter with the first and second threshold values.

Statement 5. The method of any of the preceding statements, wherein the method further comprises:

deferring the generation of the notification based on the value of the second parameter.

Statement 6. The method of any of the preceding statements, wherein the first parameter is a remaining quantity of a consumable of the vehicle.

Statement 7. The method of any of the preceding statements, wherein the second parameter comprises a rate of change of the first parameter.

Statement 8. The method of any of the preceding statements, wherein the second parameter comprises a time of day, week, month or year.

Statement 9. The method of any of the preceding statements, wherein the second parameter comprises a location or predicted future location of the vehicle.

Statement 10. The method of any of the preceding statements, wherein the second parameter comprises an indication of a proximity of the vehicle to a service station or garage and/or proximity of a route planned or predicted to be performed by the vehicle to a service station or garage.

Statement 11. The method of any of the preceding statements, wherein the second parameter comprises an environmental condition in which the vehicle is operating or is predicted to operate.

Statement 12. The method of any of the preceding statements, wherein the method comprises determining a value of the first and/or second threshold based on a historical driving condition of the vehicle.

Statement 13. The method of any of the preceding statements, wherein the method comprises determining a value of the first and/or second threshold based on a model, and/or a cargo storage and/or passenger compartment configuration of the vehicle.

Statement 14. The method of any of the preceding statements, wherein the method comprises determining a value of the first and/or second threshold based on an anticipated use of the vehicle.

Statement 15. A notification system for a vehicle, the notification system comprising:

a sensor configured to determine a first parameter of the vehicle; and a controller configured to:

identify a second parameter based on an association of the second parameter with the first parameter;

compare the value of the first parameter to a first threshold value and a second threshold value; and generate a notification notifying the user of the value of the first parameter based on the second parameter if the value of the first parameter is between the first and second thresholds.

Statement 16. The notification system of statement 15, wherein the controller is configured to perform the method of any of statements 1 to 14.

Statement 17. The notification system of statement 15 or 16, wherein the sensor is a fuel level sensor, a wash liquid level sensor or an oil temperature sensor.

It will be appreciated by those skilled in the art that although the disclosed subject matter has been described by way of example, with reference to one or more exemplary examples, it is not limited to the disclosed examples and that alternative examples could be constructed without departing from the scope of the disclosed subject matter as defined by the appended claims.

The invention claimed is:

1. A method of generating a notification, the notification to notify a user of a value of a first parameter of a vehicle, the method comprising:

identifying a second parameter based on an association of the second parameter with the first parameter;

comparing the value of the first parameter to a first threshold value and a second threshold value; and responsive to a determination that the value of the first parameter is between the first threshold value and the second threshold value, generating the notification notifying the user of the value of the first parameter;

wherein one or both of the first threshold value and the second threshold value are determined based on at least one of a historical driving condition of the vehicle or an anticipated use of the vehicle.

2. The method of claim 1, wherein the method comprises generating the notification based on a comparison of a value of the second parameter with a third threshold value responsive to the determination that the value of the first parameter is between the first threshold value and the second threshold value.

3. The method of claim 1, wherein the method further comprises:

generating the notification based on the comparison of the value of the first parameter with the first and second threshold values when the value of the first parameter is greater than both of the first and second threshold values or the value of the first parameter is less than both of the first and second threshold values.

4. The method of claim 1, wherein a form or a content of the notification is determined based on the value of the second parameter.

5. The method of claim 1, wherein the method further comprises:

deferring the generation of the notification based on the value of the second parameter.

6. The method of claim 1, wherein the first parameter is a remaining quantity of a consumable of the vehicle.

7. The method of claim 1, wherein the second parameter is a rate of change of the first parameter.

8. The method of claim 1, wherein the second parameter is a time of day, week, month or year.

9. The method of claim 1, wherein the second parameter is a location or predicted future location of the vehicle.

10. The method of claim 1, wherein the second parameter indicates one or both of:

a proximity of the vehicle to a service station or garage; and a proximity of a route planned or predicted to be performed by the vehicle to a service station or garage.

11. The method of claim 1, wherein the second parameter indicates an environmental condition in which the vehicle is operating or is predicted to operate.

12. The method of claim 1, wherein the method comprises one or both of:

determining the first threshold value based on one or more of:

a model;

a cargo storage configuration of the vehicle; and a passenger compartment configuration of the vehicle; and determining the second threshold value based on one or more of:

the model;

the cargo storage configuration of the vehicle; and the passenger compartment configuration of the vehicle.

13. A notification system for a vehicle, the notification system comprising:

a sensor configured to determine a value of a first parameter of the vehicle; and a controller configured to:

identify a second parameter based on an association of the second parameter with the first parameter;

compare the value of the first parameter to a first threshold value and a second threshold value; and responsive to a determination that the value of the first parameter is between the first threshold value and the second threshold value:

compare a value of the second parameter to a third threshold value; and generate the notification notifying the user of the value of the first parameter based on the comparison of the value of the second parameter with the third threshold value;

wherein one or both of the first threshold value and the second threshold value are determined based on at least one of a historical driving condition of the vehicle or an anticipated use of the vehicle.

14. The notification system of claim 13, wherein the sensor is a fuel level sensor, a wash liquid level sensor or an oil temperature sensor.

15. The notification system of claim 13, wherein a form or a content of the notification is determined based on the value of the second parameter.

16. The notification system of claim 13, wherein the first parameter is a remaining quantity of a consumable of the vehicle.

17. The notification system of claim 13, wherein the second parameter indicates a rate of change of the first parameter.

18. The notification system of claim 13, wherein determining the first threshold value and the second threshold value includes one or both of:

determining the first threshold value based on one or more of:

a model;

a cargo storage configuration of the vehicle; and a passenger compartment configuration of the vehicle; and determining the second threshold value based on one or more of:

the model;

the cargo storage configuration of the vehicle; and the passenger compartment configuration of the vehicle.

19. A notification system for a vehicle, the notification system comprising:

a sensor configured to determine a value of a first parameter of the vehicle; and a controller configured to:

identify a second parameter based on an association of the second parameter with the first parameter;

compare the value of the first parameter to a first threshold value and a second threshold value; and responsive to a determination that the value of the first parameter is between the first threshold value and the second threshold value:

compare a value of the second parameter to a third threshold value; and generate the notification notifying the user of the value of the first parameter based on the comparison of the value of the first parameter with the first and second threshold values when the value of the first parameter is greater than both of the first and second threshold values or the value of the first parameter is less than both of the first and second threshold values.

20. The notification system of claim 18, wherein one or both of the first threshold value and the second threshold value are determined based on at least one of a historical driving condition of the vehicle or an anticipated use of the vehicle.

21. The notification system of claim 18, wherein determining the first threshold value and the second threshold value includes one or both of:

determining the first threshold value based on one or more of:

a model;

a cargo storage configuration of the vehicle; and a passenger compartment configuration of the vehicle; and determining the second threshold value based on one or more of:

the model;

the cargo storage configuration of the vehicle; and the passenger compartment configuration of the vehicle.

* * * * *